US005813559A

United States Patent [19]

Cho

[11] Patent Number: 5,813,559

[45] Date of Patent: Sep. 29, 1998

[54] BEVERAGE CAN WITH SANITARY COVER

[76] Inventor: Sung Ho Cho, 517-17 AnYang 6th-dong, AnYang-City Kyeongki-Province, Rep. of Korea

[21] Appl. No.: 757,918

[22] Filed: Nov. 27, 1996

[30] Foreign Application Priority Data

Nov. 28, 1995 [KR] Rep. of Korea ..... 1995-44065

[51] Int. Cl.[6] ..... B65D 51/22

[52] U.S. Cl. ..... 220/258; 220/259; 220/269; 220/336; 220/716; 220/906

[58] Field of Search ..... 220/258, 259, 220/269, 336, 716, 729, 906

[56] References Cited

U.S. PATENT DOCUMENTS

| | | | |
|---|---|---|---|
| 4,463,866 | 8/1984 | Mandel | 220/269 |
| 4,673,099 | 6/1987 | Wells | 220/269 |
| 4,865,215 | 9/1989 | Wells | 220/269 |
| 4,951,835 | 8/1990 | DeMars et al. | 220/269 |
| 4,979,635 | 12/1990 | Levine | 220/269 |
| 5,080,249 | 1/1992 | Shock | 220/269 |
| 5,351,853 | 10/1994 | Shock | 220/258 X |

*Primary Examiner*—Stephen Cronin
*Attorney, Agent, or Firm*—Birch, Stewart, Kolasch & Birch, LLP

[57] ABSTRACT

A beverage can, provided with sanitary covering means for normally covering the lip portion of the rim nearest the opening cover of the can during storage, is disclosed. The sanitary covering means may be formed separately from the attached lever opener. In this case, the sanitary covering means is rotatably attached on the top of the can by the opener's rivet at a portion between the lever opener and the top of the can. Alternatively, the sanitary covering means may be cast with the lever opener as a single structure. In this case, the lever opener is rotatably rivetted on the top of the can and radially extends outward while being widened in order to form a sanitary cover part used as the sanitary covering means and passes over the rim in order to form a rim cover part covering a part of the rim. The rim cover part may be curved in order to movably surround a part of the rim's top.

7 Claims, 9 Drawing Sheets

BEVERAGE CAN WITH SANITARY COVER

BACKGROUND OF THE INVENTION

1. Field of the Invention

The present invention relates, in general, to beverage cans and, more particularly, to a structural improvement in such cans for covering the lip portion of the rim nearest the opening cover of a can during storage of the cans thus preventing the lip portion from being contaminated by dust and other toxic materials.

2. Description of the Prior Art

In order to open and empty an aluminum beverage can, the lever opener, which is rivetted on the top of the can, is levered up in order to break a depressed seam and forms an opening on the top of the can. As well known to those skilled in the art, the beverage cans are kept in air while exposing their tops to the atmosphere, so that the rims of the cans are regrettably contaminated by dust and other toxic materials. During use of the can, the lip portion of a contaminated rim is bad for one's health. In an effort to overcome the above problem, a can, whose top is provided with either a compression-restitutive suction straw or a reusable top closure, was proposed. However, it is almost impossible to produce the can, which is provided with either the compression-restitutive suction straw or the reusable top closure, in great quantity, so that the above beverage can not be produced on a commercial scale.

SUMMARY OF THE INVENTION

It is, therefore, an object of the present invention to provide a beverage can in which the above problems can be overcome and to provide with a sanitary covering means for normally covering the lip portion of the rim nearest the opening cover of the can during storage, thus preventing contamination of the lip portion of the rim and thereby being better for one's health.

In an embodiment, the present invention provides a beverage can comprising a lever opener attached on the top of the can by a rivet, and an opening cover to be selectively levered down upon by the lever opener in order to open the can, further comprising: a sanitary cover normally covering a rim's lip portion nearest the opening cover and thereby preventing the lip portion from being contaminated during storage, the sanitary cover being wide enough to effectively cover the lip portion and being rotatably attached on the top of the can by the rivet at a portion between the lever opener and the top of the can.

In another embodiment, the present invention provides a beverage can comprising a lever opener attached on the top of the can by a rivet, and an opening cover to be selectively levered down upon by the lever opener in order to open the can, wherein the lever opener is rotatably attached on the top of the can by the rivet and radially extends outward while being widened in order to form a sanitary cover part normally covering a rim's lip portion nearest the opening cover and passes over the rim in order to form a rim cover part covering a part of the rim, and is partially cut at a portion around the rivet in order to form an arcuate slot defining a rivetted point of action of the lever opener.

BRIEF DESCRIPTION OF THE DRAWINGS

The above and other objects, features and other advantages of the present invention will be more clearly understood from the following detailed description taken in conjunction with the accompanying drawings, in which:

FIGS. 1A and 1B are plan views showing the configuration and construction of the top of a beverage can provided with a sanitary covering means according to the primary embodiment of the present invention, in which:

FIG. 1A shows the sanitary covering means in the closed position where the means covers the lip portion of the rim; and FIG. 1B shows the covering means in the open position where the means is rotated from the closed position at 180° degrees in order to expose the opening cover before the can is opened;

FIGS. 4A and 4B are sectional views of the top of the beverage can according to the second embodiment of this invention, in which:

FIG. 4A shows the sanitary covering means positioned in the closed position; and FIG. 4B shows the sanitary covering means of which the rim cover part is elastically separated from the rim of the can before the can is opened;

FIGS. 7A and 7B are plan views showing the configuration and construction of the top of a beverage can provided with a sanitary covering means according to the fourth embodiment of this invention, in which:

FIG. 7A shows the sanitary covering means in the closed position where the means covers the lip portion of the rim; and FIG. 7B shows the covering means in the open position where the means is levered up in order to break the depressed seam thus opening the can;

DESCRIPTION OF THE PREFERRED EMBODIMENTS

Figure 1B:
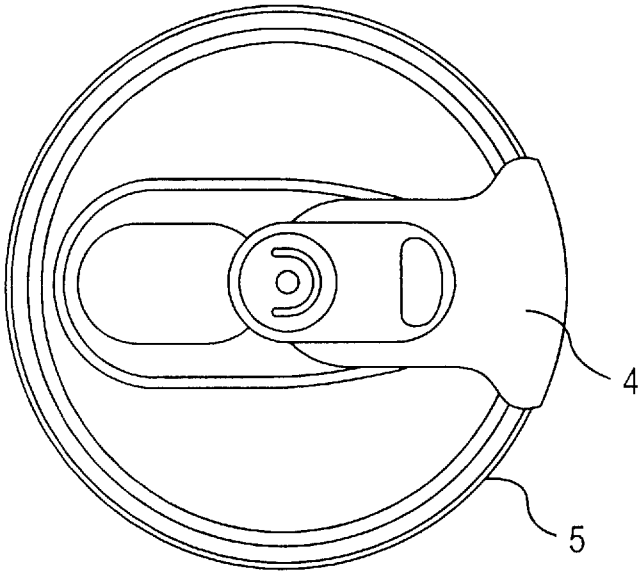
Figure 1A:
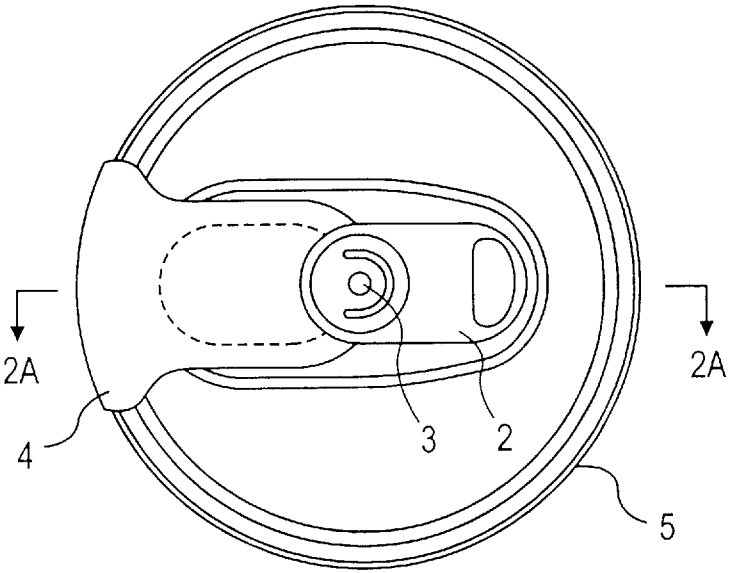
Figure 2B:
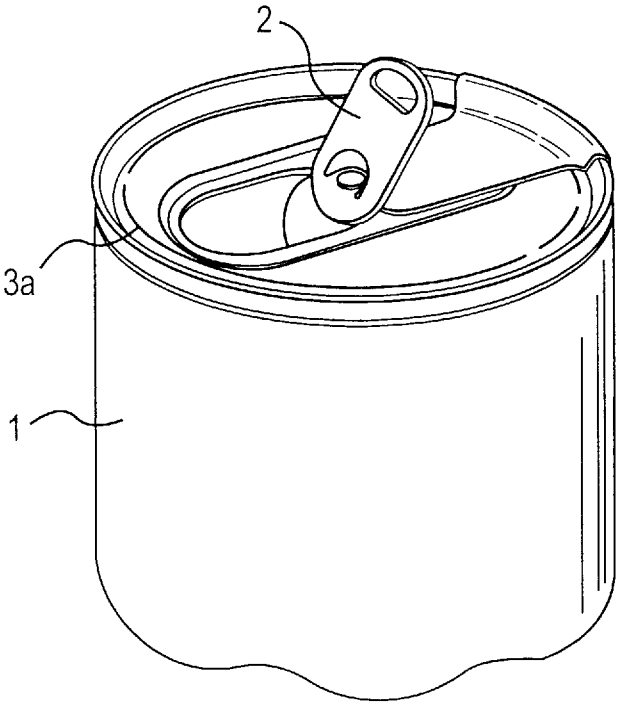
FIG. 2B is a perspective view showing the top of the beverage can when the attached lever opener is levered up in order to open the can.

FIGS. 1A, 1B, 2A 2B and 2C show a beverage can in accordance with the primary embodiment of this invention. As shown in the drawings, the top of the beverage can 1 is provided with a lever opener 2 which is attached on the top of the can 1 by a rivet 3. The can 1 of this invention has a sanitary covering means used for normally covering the lip portion 3*a* of the rim 5 nearest the opening cover of the can 1, thereby preventing the contamination of the lip portion 3*a* during storage. In the primary embodiment, the sanitary covering means comprises a sanitary cover 4 which is rotatably attached on the top of the can 2 by the rivet 3 at a portion between the lever opener 2 and the top of the can 1. During a process for producing the can, the outside edge of the sanitary cover 4 is bent down in order to form a rim cover part which movably engages with the rim 5 and slides under the guide of the rim 5. The cover 4 normally covers the lip portion 3*a* of the rim 5 nearest the opening cover during storage of the can 1 as shown in FIG. 1A, thus preventing the lip portion 3*a* from being contaminated by dust and other toxic materials. In order to open and empty the can 1, the sanitary cover 4 in the closed position of FIG. 1A is primarily rotated about the rivet 3 at 180° degrees under the guide of the rim 5 in the direction as shown by the arrow of FIG. 1B. Thereafter, the lever opener 2, which is riveted on the top of the can 1, is levered up in order to break the depressed seam thus opening the can 1 as shown in FIG. 2B. In accordance with the primary embodiment, the lip portion 3*a*, which is normally covered with the sanitary cover 4, is effectively prevented from being contaminated during storage, so that the lip portion 3*a* is not bad for one's health when the portion 3*a* is brought into contact with a user's mouth.

Figure 3B:
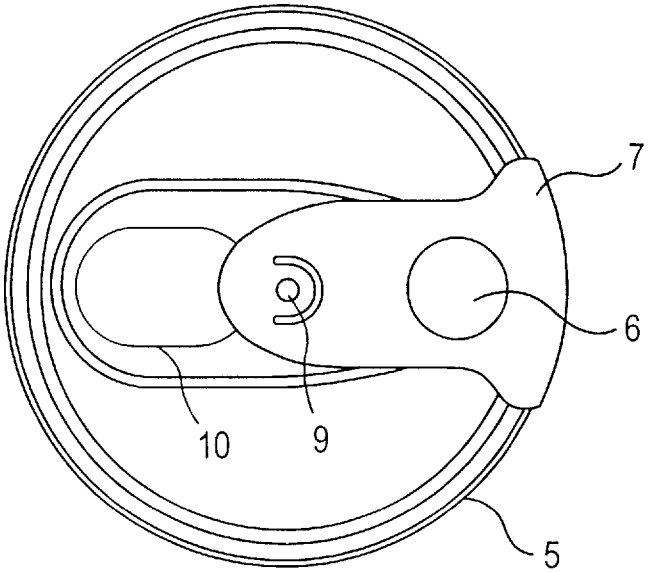
FIGS. 3A and 3B are views corresponding to FIGS. 1A and 1B respectively, but showing the second embodiment of this invention.
Figure 3A:
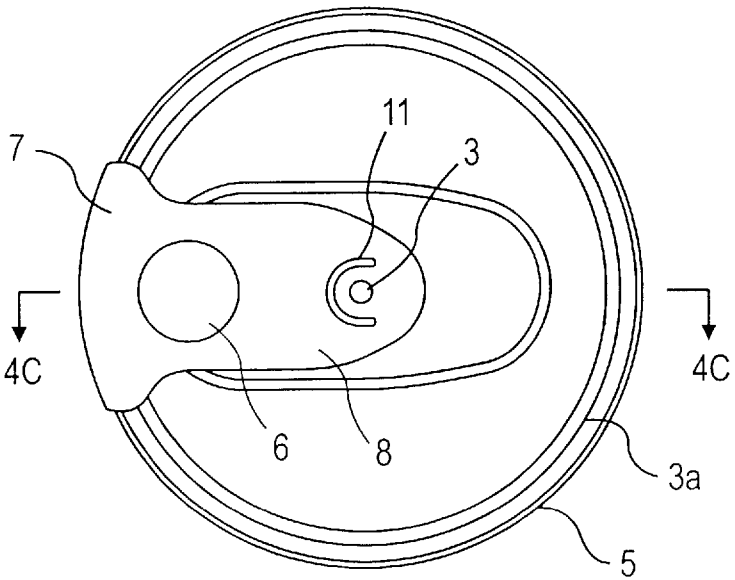
Figure 4C:
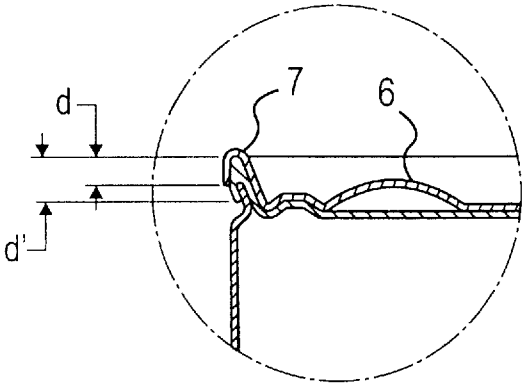
FIGS. 4C and 4D are exploded sectional views of a portion of FIGS. 4A and 4B, respectively.
Figure 4D:
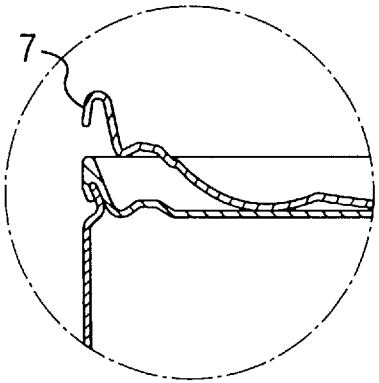
Figure 4A:
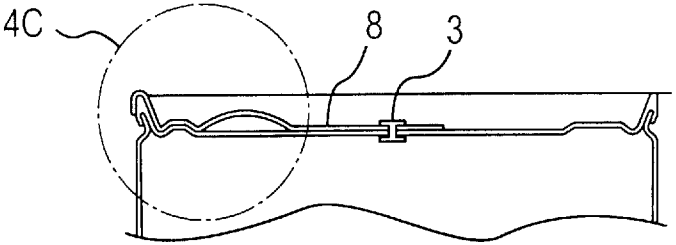
Figure 4B:
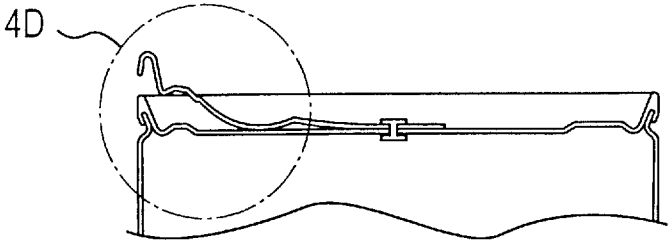
Figure 5B:
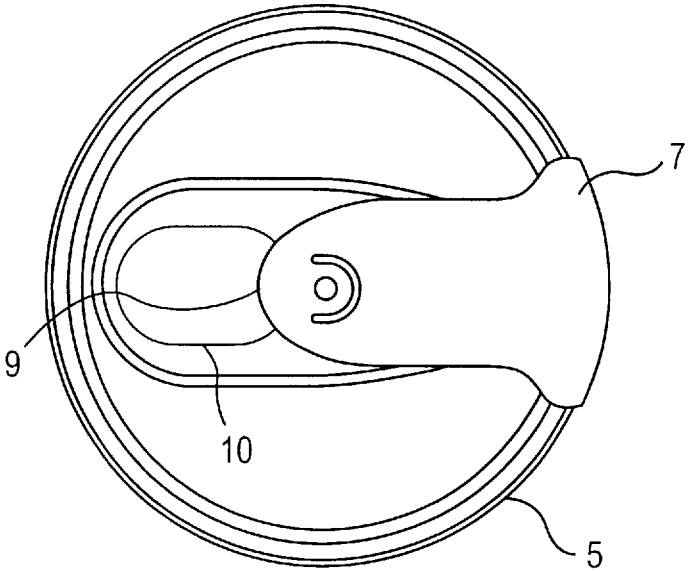
FIGS. 5A and 5B are views corresponding to FIGS. 1A and 1B respectively, but showing the third embodiment of this invention.
Figure 5A:
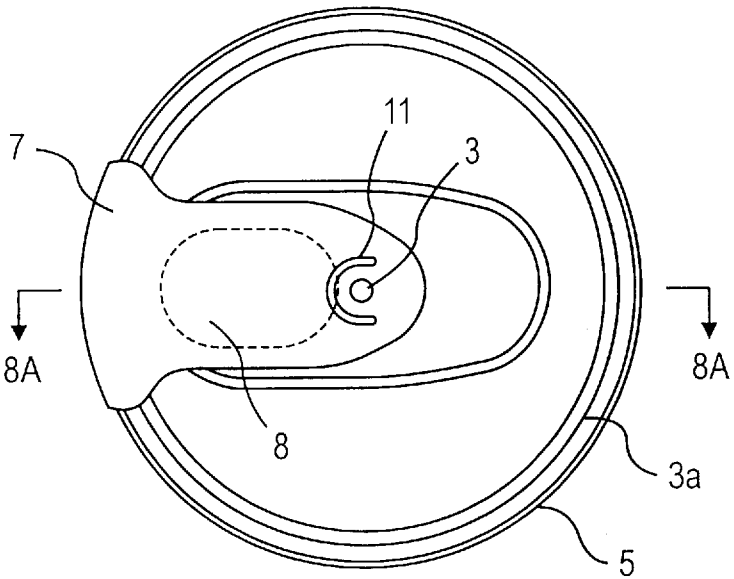
Figure 6B:
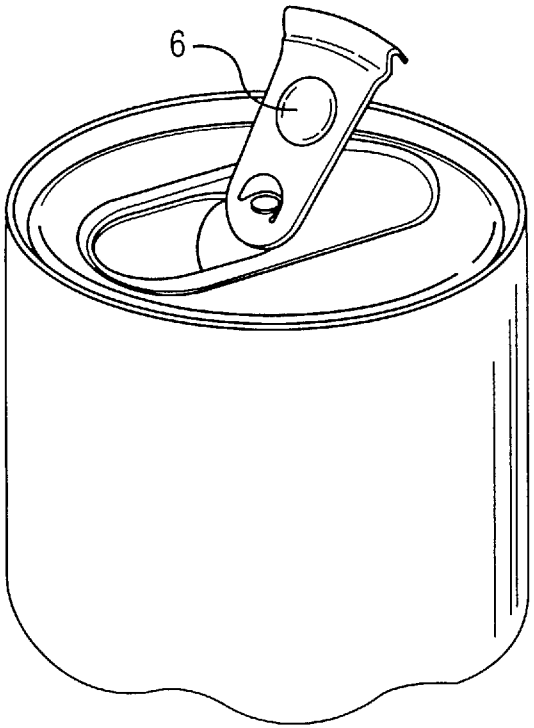
FIGS. 6A and 6B are views corresponding to FIG. 2B, but showing the third and second embodiments of this invention, respectively.
Figure 6A:
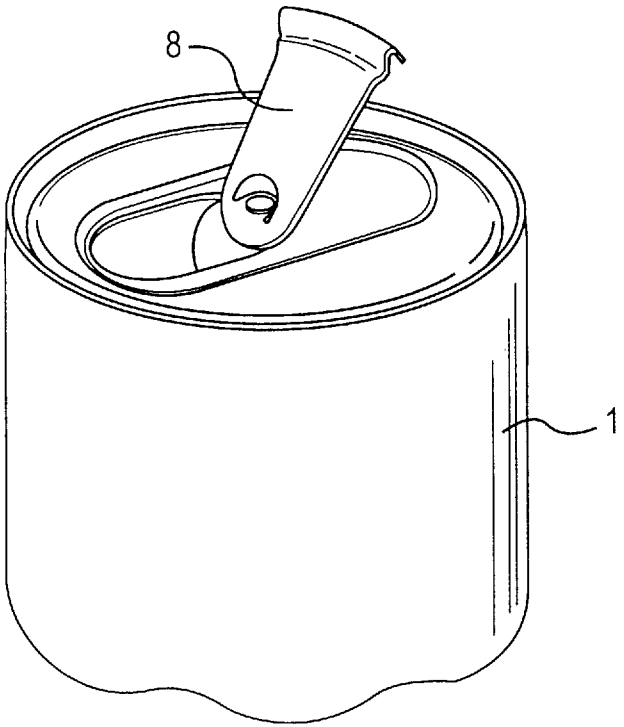

FIGS. 3A and 3B show a beverage can in accordance with the second embodiment of this invention, while FIGS. 5A and 5B show a beverage can in accordance with the third embodiment of this invention. In either the second or third embodiment, the sanitary covering means is cast with the lever opener as a single structure. That is, the covering means is rotatably attached on the top of the can by a rivet 3 and radially extends outward to a rim cover part 7 while being widened in order to form a sanitary cover part 8. The bent rim cover part 7 surrounds a part of the rim's top. The sanitary covering means is also partially cut at a portion around the rivet 3, thus forming an arcuate slot 11 defining a rivetted point of action of the sanitary covering means. The inside edge of the sanitary covering means forms a lever opener part 9. The sanitary covering means normally covers the lip portion 3*a* of the rim 5 nearest the opening cover in order to prevent the lip portion 3*a* from being contaminated by dust and other toxic materials. In order to open and empty the can, the covering means is primarily rotated from its closed position of FIG. 3A or 5A at 180° degrees in the direction as shown by the arrow of FIG. 3B or 5B thus reaching the open position of FIG. 3B or 5B. When the rivetted sanitary covering means in the above state is levered up, the lever opener part 9 breaks the depressed seam thus opening the can 1 as shown in FIG. 6A or 6B. Particularly in the second embodiment, the sanitary cover part 8 is provided with a thumb-operable resilient dome 6 as shown in FIGS. 3A and 3B. Before the covering means of the second embodiment is rotated from the closed position of FIG. 3A to the open position of FIG. 3B, the resilient dome 6 in the state of FIG. 4A is pressed down by a thumb thereby elastically separating the rim cover part 7 from the rim 5 as shown in FIG. 4B. The sanitary covering means provided with the resilient dome 6 is thus more convenient to users while opening the can 1.

Figure 7B:
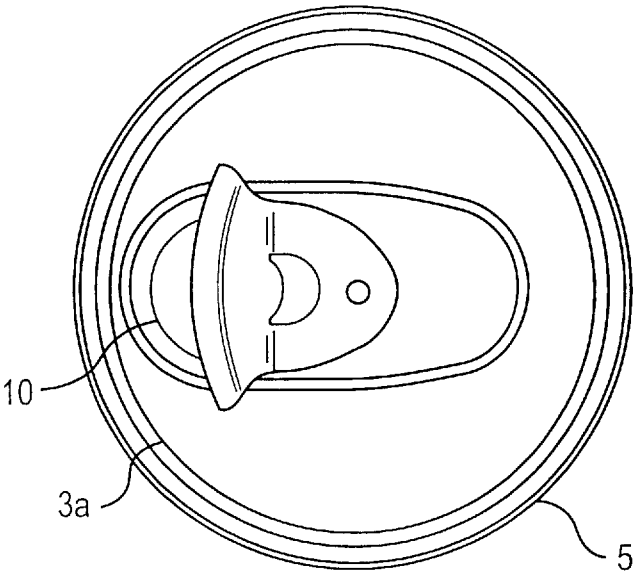
Figure 7A:
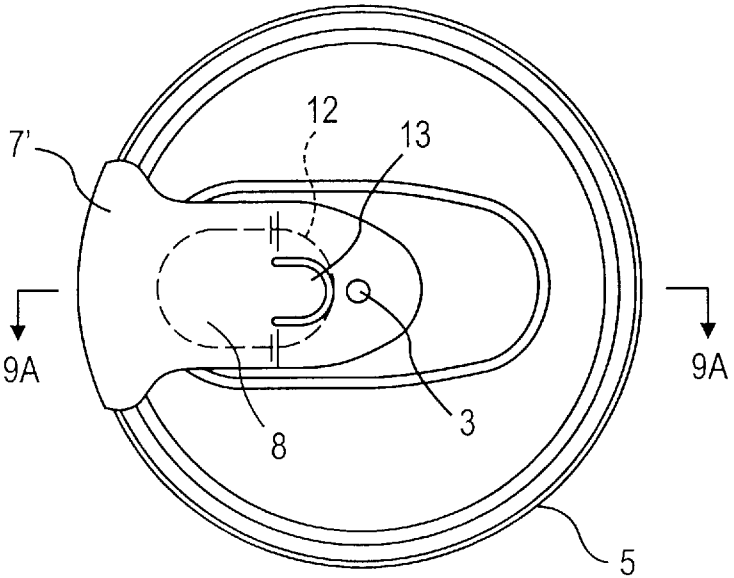
Figure 8B:
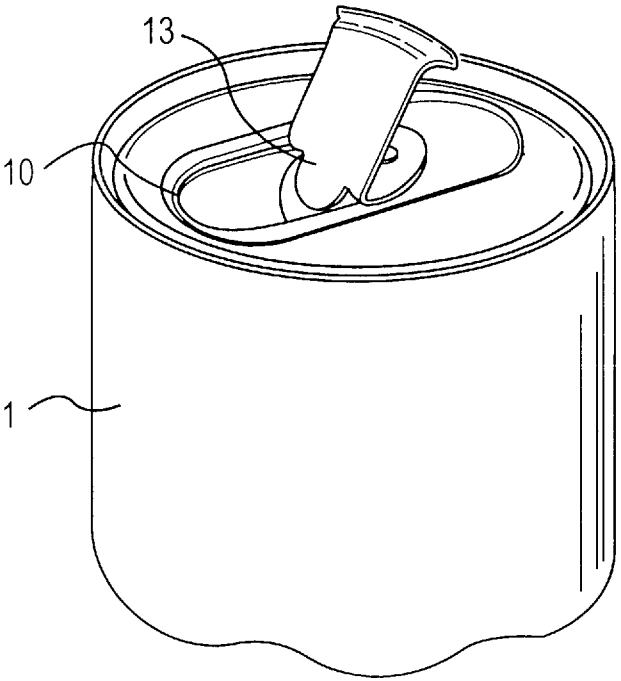
FIGS. 8A and 8B are views corresponding to FIGS. 2A and 2B respectively, but showing the fourth embodiment of this invention.
Figure 8A:
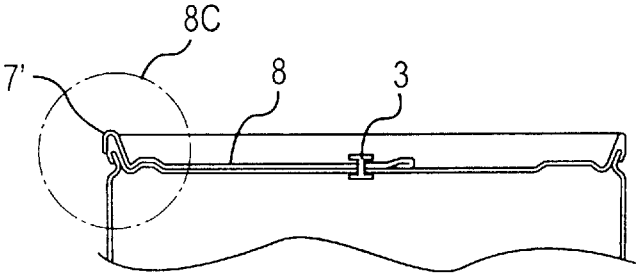
Figure 8C:
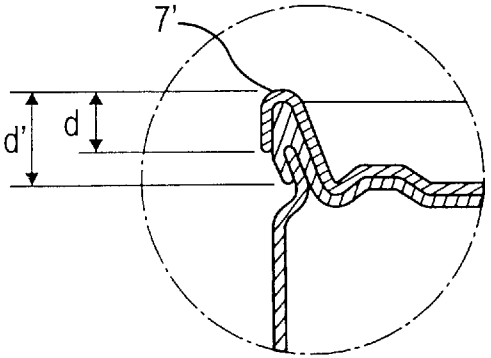
FIG. 8C is an exploded view of a portion of FIG. 8A.

FIGS. 7A and 7B show a beverage can in accordance with the fourth embodiment of this invention. In the fourth embodiment, the sanitary covering means is cast with the lever opener as a single structure in a manner similar to that described for the second or third embodiment. However, different from the second or third embodiment, the sanitary covering means of the fourth embodiment more simply opens the can. That is, in order to open the can, the covering means of the fourth embodiment in the closed position is levered up in the same position without being rotated to the open position. The covering means of this embodiment is attached on the top of the can by a rivet 3 and radially extends outward to a rim cover part 7' while being widened in order to form a sanitary cover part 8. The covering means is partially depressed in order to form a U-shaped seam at a position above the rear portion of the opening of the can 1 thereby forming a U-shaped lever opener part 13. The covering means also includes two depressed bending lines 12, at which the rivetted covering means is bent in order to cause the lever opener part 13 to lever down the opening cover and to open the can. The two bending lines 12 are transversely formed on the covering means in a way such that the bending lines 12 extend outward from both ends of the U-shaped seam of the lever opener part 13 and pass over the opening cover's seam 10. The operational effect of the fourth embodiment is shown in FIG. 8A and 8B. When the rim cover part 7' in the closed position is levered up, the covering means is bent at the bending lines 12 as shown in FIGS. 8A and 8B. The lever opener part 13 in the above state levers down the opening cover, thus breaking the seam 10 and thereby opening the can 1. The covering means of the fourth embodiment covers the lip portion 3*a* of the rim 5 nearest the opening cover during storage of the can 1, so that the covering means effectively prevents the lip portion 3*a* from being contaminated by dust and other toxic materials. The above covering means is more easily operated during use of the can 1, thus being more convenient to users.

It should be understood that the sanitary covering means of the fourth embodiment may be provided with the thumb-operable resilient dome 6, which yields the same result as that described for the second embodiment without affecting the functioning of the fourth embodiment. In addition, an antibiotic fabric or cotton may be interposed between the sanitary covering means and the lip portion of the rim during production of the can, thus increasing the operational effect of the covering means.

Figure 9B:
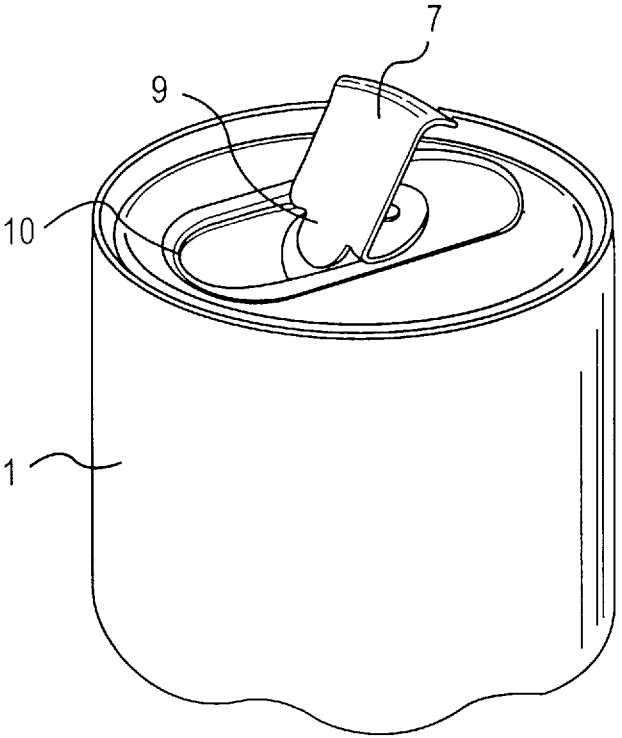
FIGS. 9A and 9B are sectional views showing the construction of the top of a beverage can provided with a sanitary covering means according to the fifth embodiment of this invention.
Figure 9A:
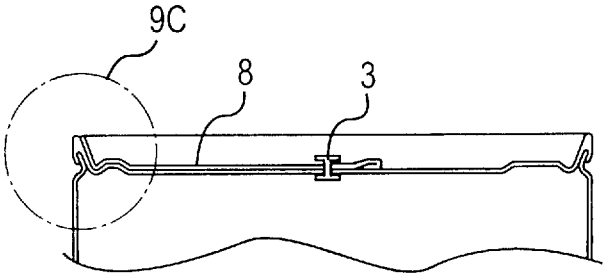
Figure 9C:
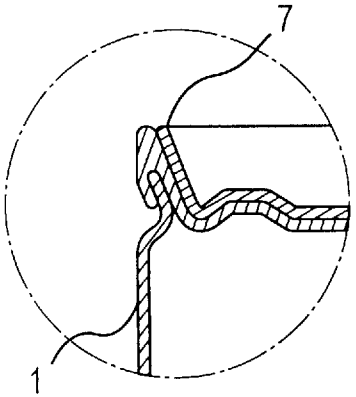
FIG. 9C is an exploded view of a portion of FIG. 9A.

FIGS. 9A, 9B and 9C shows the construction of the top of a beverage can provided with a sanitary covering means according to the fifth embodiment of this invention. In the sanitary covering means of the fifth embodiment, the rim cover part 7 is not bent but is straightened in order to be horizontally positioned on the rim 5. The covering means of the fifth embodiment is particularly suitable for preventing the rim cover part 7 from being regrettably rolled over the rim 5 and from integration with the rim 5 during mass-production of the cans.

Figure 2A:
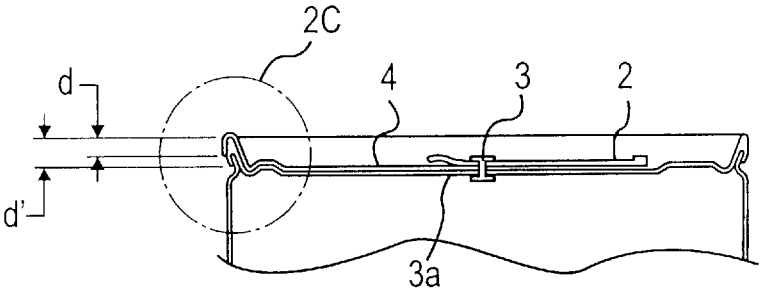
FIG. 2A is a sectional view of the top of the beverage can according to the primary embodiment of this invention.
Figure 2C:
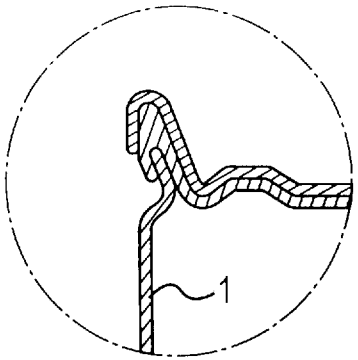
FIG. 2C is an exploded view of the lip portion of the rim.

As shown in FIGS. 2A and 8A, in order to prevent the rim cover part 7 of the second or fourth embodiment from being rolled over the rim 5 and from integration with the rim 5 while seaming the junction between the top and container of the can, the height (d) of the rim cover part 7 must be lower than the height (d') of the rim 5.

As described above, the present invention provides a structurally-improved beverage can. In the beverage can of this invention, a sanitary covering means covers the lip portion of the rim nearest the opening cover during storage of the can, thus preventing the lip portion from being contaminated by dust and other toxic materials. The sanitary covering means is simply attached on the top of the can by the rivet of the attached lever opener, so that the beverage can of this invention can be produced in a large quantity different from a typical beverage can.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A beverage can comprising a lever opener attached on the top of the can by a rivet, and an opening cover to be selectively levered down by said lever opener in order to open the can, further comprising:

sanitary cover means normally covering a rim's lip portion nearest the opening cover and thereby preventing the lip portion from being contaminated during storage of the can, said sanitary cover means being rotatably attached on the top of said can by the rivet at a portion between said lever opener and the top of the can and being wide enough to effectively cover the lip portion, and extending in order to pass over a rim of the can thus forming a rim cover part covering a part of said rim.

2. A beverage can comprising a lever opener attached on the top of the can by a rivet, and an opening cover to be selectively levered down by said lever opener in order to open the can, wherein said lever opener is rotatably attached on the top of the can by the rivet and radially extends outward while being widened in order to form a sanitary cover means normally covering a rim's lip portion nearest the opening cover and passes over a rim of the can in order to form a rim cover part covering a part of said rim, and is partially cut at a portion around the rivet in order to form an arcuate slot defining a rivetted point of action of said lever opener.

3. A beverage can comprising a lever opener attached on the top of the can by a rivet, and an opening cover defined on the top of the can by a depressed seam and selectively levered down by said lever opener in order to open the can, wherein said lever opener is attached on the top of the can by the rivet and radially extends outward while being widened in order to form a sanitary cover means normally covering a rim's lip portion nearest the opening cover and passes over a rim of the can in order to form a rim cover part covering a part of said rim and is partially depressed in order to form a U-shaped seam at a position above a rear portion of said opening cover thereby forming a U-shaped lever opener part, and is provided with a depressed bending line for allowing the sanitary cover part to be selectively bent at said bending line in order to lever down the opening cover by said lever opener part, said bending line transversely extending outward from both ends of said U-shaped seam of the lever opener part and passing over said depressed seam of the opening cover.

4. The beverage can according to any one of claims 1 to 3, wherein said rim cover part is curved down in order to movably surround a part of the top of said rim thereby being slidable under the guide of said rim, said curved rim cover part having a height of lower than a height of the rim.

5. The beverage can according to claim 4, wherein said sanitary cover part is provided with a thumb-operable resilient dome, said resilient dome being selectively pressed down by a thumb in order to elastically separate the rim cover part from the rim.

6. The beverage can according to any one of claims 1 to 3, wherein said rim cover part is straightened in order to be horizontally positioned on said rim.

7. The beverage can according to claim 6, wherein said sanitary cover part is provided with a thumb-operable resilient dome, said resilient dome being selectively pressed down by a thumb in order to elastically separate the rim cover part from the rim.

* * * * *